United States Patent [19]

Brux

[11] 4,401,020

[45] Aug. 30, 1983

[54] VEGETABLE BANDING APPARATUS

[75] Inventor: Robert A. Brux, Salinas, Calif.

[73] Assignee: Seaco Industries, Salinas, Calif.

[21] Appl. No.: 331,153

[22] Filed: Dec. 16, 1981

[51] Int. Cl.[3] ..... B65B 13/30

[52] U.S. Cl. ..... 100/7; 53/390; 99/635; 100/9; 198/637

[58] Field of Search ..... 100/2, 6, 7, 9; 53/390, 53/515, 441; 99/635; 198/637

[56] References Cited

U.S. PATENT DOCUMENTS

| | | | |
|---|---|---|---|
| 2,682,288 | 6/1954 | Magnuson | 100/6 |
| 3,320,989 | 5/1967 | Verardo | 100/6 X |
| 3,393,633 | 7/1968 | Hoffman | 100/2 |

FOREIGN PATENT DOCUMENTS

| | | | |
|---|---|---|---|
| 747347 | 9/1944 | Fed. Rep. of Germany | 100/9 |

*Primary Examiner*—Billy J. Wilhite

*Attorney, Agent, or Firm*—Claude A. S. Hamrick

[57] ABSTRACT

Bundles of vegetables such as broccoli, and the like, are banded by apparatus (10) comprising an expander assembly (18) having a plurality of arms (86, 86', 86") which swing toward and away from one another about axes perpendicular to a phase of an associated segment in order to expand and contract an elastic band (E) placed on the arms when retracted and permit a worker to place a bundle to be banded within an expanded band. A plurality of expander assemblies (18) can be mounted on a continuous conveyor (14, 14') formed by a plurality of planar segments (16) articulated to one another and each supporting a respective expander assembly. Banded bundles are removed from conveyor (14, 14') by an extractor arrangement (30) including a pair of opposed belts (32, 32') provided with flexible fingers (34) which engage the banded bundles in a protective manner in order to remove them from an associated expander assembly (18). Structure (1010) is disclosed for trimming banded bundles prior to removal from an associated expander assembly (18).

34 Claims, 9 Drawing Figures

VEGETABLE BANDING APPARATUS

BACKGROUND OF THE INVENTION

1. Field of the Invention

This invention relates generally to food banding apparatus, and more particularly, to an improved apparatus for use in the banding of broccoli, and the like.

2. Description of the Prior Art

The handling of irregularly shaped foodstuffs, such as broccoli, presents many problems in that they must be bunched, trimmed, and tied together in some manner before being ready for market. Traditionally, these operations have been performed by hand.

In order to make the process of readying such vegetables as broccoli for market, it has been proposed to mechanize the trimming operations. In one apparatus proposed for such purpose, cup-like bins are provided for supporting the heads of bunches of broccoli. Mounted on the front of each of these bins are two pivotally mounted arms, a first of which is held open by a return spring and the second of which is held open by an overcenter spring connected to the first arm. The bins are carried around an endless loop by a motor driven chain. After an operator loads one of the bins with broccoli, the bin is driven over a plate which camingly engages the first arm so as to overcome the bias of the overcenter spring and cause the arms to close over the stems of the broccoli and hold them in place while a saw trims the ends of the stalks. Once trimmed, however, a worker must still place a band over the stalks.

An example of a device intended for facilitating hand operated banding of such elongated fruit and vegetables as bananas, celery, asparagus, and the like, can be found in U.S. Pat. No. 2,882,660, issued Apr. 21, 1959, to H. P. Denton. Further, U.S. Pat. No. 3,974,762, issued Aug. 17, 1976, to E. K. Kita, et al., discloses apparatus for disposing elastic bands on a fixture in preparation for banding of produce bunches by closing an elastic band manually placed on the fixture when the bunch is inserted into the fixture so as to displace a movable platform forming a bottom of the apparatus.

It has furthered been proposed, as disclosed in U.S. Pat. No. 4,095,391, issued June 20, 1978, to B. E. Anguiano, to provide broccoli bunching apparatus which includes a plurality of buckets driven around a first endless loop. Each bucket has a head supporting portion for supporting the head of a bunch of broccoli, and a U-shaped stalk support for supporting broccoli stalks and for carrying a tie band. A plurality of U-shaped clamps which are driven in synchronization with the buckets around a second endless loop disposed above and behind the stalk supports compressingly hold a bunch of broccoli stalks against a corresponding stalk support while a saw trims the stocks. As in the apparatus discussed above, however, once the stocks are trimmed, workers must manually arrange the tied bands over the ends of the stalks.

Finally, it has been proposed to band bundles of fruit or vegetables, and the like, by apparatus such as shown in U.S. Pat. No. 3,386,371, issued June 4, 1968, to H. L. Farmer, et al., that comprises a frame on which is mounted an expander assembly including a plurality of arms which swing toward and away from one another about horizontal axes. When swung away from one another, the arms will expand an elastic band arranged on them and permit a bundle which is to be banded to be inserted into the expanded band. Once the bundle is disposed within the expanded band, the arms can be swung back toward one another so as to cause the elastic band to grippingly embrace the bundle. A principal drawback with this approach is that a worker can operate only one device, or work station, inasmuch as the worker must take bundles one at a time and place them between the expanded arms, hold the bundle in place until the arms are retracted, and then withdraw the banded bundle from between the arms.

U.S. Pat. No. 3,078,631, issued Feb. 26, 1963, to S. Seserman, discloses an elastic banding device having provision for applying an elastic band about an article or group of articles placed within a frame on which a supply of elastic bands have been stretched and stored. Provision is made for releasing successive foremost ones of the stretched elastic bands so as to constrict about an article or articles being banded.

U.S. Pat. No. 2,236,936, issued Apr. 1, 1941, to W. W. Camp, discloses a device for applying elastic bands in which the bands are arranged on a spool member vertically disposed over an article to be banded. The lowermost of the bands is selectively removed from the spool member and placed on an article or articles being banded by action of a pair of swinging fingers which engage the band and move same over a pair of cooperating guides and over the article or articles disposed below the spool member. Further, U.S. Pat. Nos. 3,393,633 and 3,186,333, issued July 23, 1968, and June 1, 1965, to H. R. Hoffman, et al., disclose an apparatus and method in which a plurality of partially formed elastic bands are retained in the shape of a sleeve or tube by an uncut strip along one side of the bands. The lowermost partially-cut band of the tube is engaged by an advancing blade which causes that band to be disengaged from the remaining bands and to be pivoted downwardly and rearwardly with respect to the vertically disposed tube, with the uncut portion of the band serving as a hinge or pivot point until the band is passed over a plurality of expanders which are disposed closely adjacent to one another in a horizontal line beneath the lowermost band being pivoted. Now, the expander fingers can be shifted apart and moved downwardly and outwardly so as to expand the band they engage and simultaneously cause the band to be torn from the aforementioned tube.

U.S. Pat. Nos. 2,732,115, issued Jan. 24, 1956, to H. G. Allen, and 4,127,978, issued Dec. 5, 1978, to F. Lucke, disclose devices intended for arranging nonelastic bands on bottle necks and balls of yarn, and the like, and which employ movable fingers that engage the band to facilitate the placement. In U.S. Pat. No. 2,732,115, a flattened band is initially opened by asserting opposing tangential forces on the flat sides of the band.

SUMMARY OF THE PRESENT INVENTION

It is an object of the present invention to provide vegetable banding apparatus which will permit trimmed bundles of broccoli, and the like, to be tied in a more efficient manner than can be achieved by techniques presently in use.

It is another object of the present invention to provide banding apparatus which is capable of handling large quantities of vegetables, and the like, to be banded in a safe and efficient manner without risk of serious damage to the foodstuffs.

Yet another object of the present invention is to provide vegetable banding apparatus which will permit a single worker to perform only the loading of bundles into the apparatus, with banding, trimming, and removal of banded bundles being entirely mechanized.

Briefly, these and other objects are achieved according to the present invention by providing vegetable banding apparatus comprising a supporting frame on which a carrier conveyor is moveably supported in a manner so as to receive bundles to be banded. This carrier conveyor includes a plurality of segments articulated to one another and each having provided thereon an expander assembly capable of being used individually as well and of expanding and retracting elastic bands by use of arms rotatable about substantially vertical axes. An actuator arrangement preferably including a chain and sprocket drive swings all of the arms in unison upon pivoting of one of the arms due to caming action resulting by movement of the expander assembly relative to a cam rail mounted on the frame supporting the continuous conveyor. A latch retains the arms in band-expanding mode until a bundle to be banded is placed in the expanded band. Advantageously, there are a pair of such carrier conveyors arranged in spaced, parallel, co-extensive relation, with an endless conveyor being arranged between such pair of carrier conveyors and preferably at a higher elevation so as to permit bundles to be banded to be diverted from the conveyor and onto aprons leading to the continuous conveyors and placing the bundles in position for workers to insert the bundles into the expander assemblies for banding. A loading arrangement can be provided for placing elastic bands on the arms of the expander assemblies prior to caming of the arms into a position expanding a band so placed, while banded bundles can be trimmed and removed from an associated conveyor carrying the expander assemblies by use of a discharge arrangement preferably comprising a pair of flexible, opposed belts which will gently withdraw the bundles from the associated expander assemblies.

It is an advantage of the present invention that banding and trimming of broccoli and similar foodstuffs is greatly expedited without risk of harm to the foodstuffs.

It is another advantage of the present invention that a worker is free to insert bundles to be banded into a band expander assembly in rapid sequence, without having to subsequently manipulate the bands or remove banded bundles from the apparatus.

These and other objects and advantages of the present invention will no doubt become apparent to those skilled in the art after having read the following detailed description of the preferred embodiments as accompanied by the several figures of the drawing.

IN THE DRAWING

DESCRIPTION OF THE PREFERRED EMBODIMENTS

Description of the Embodiment of FIGS. 1-7

Figures 1, 7:
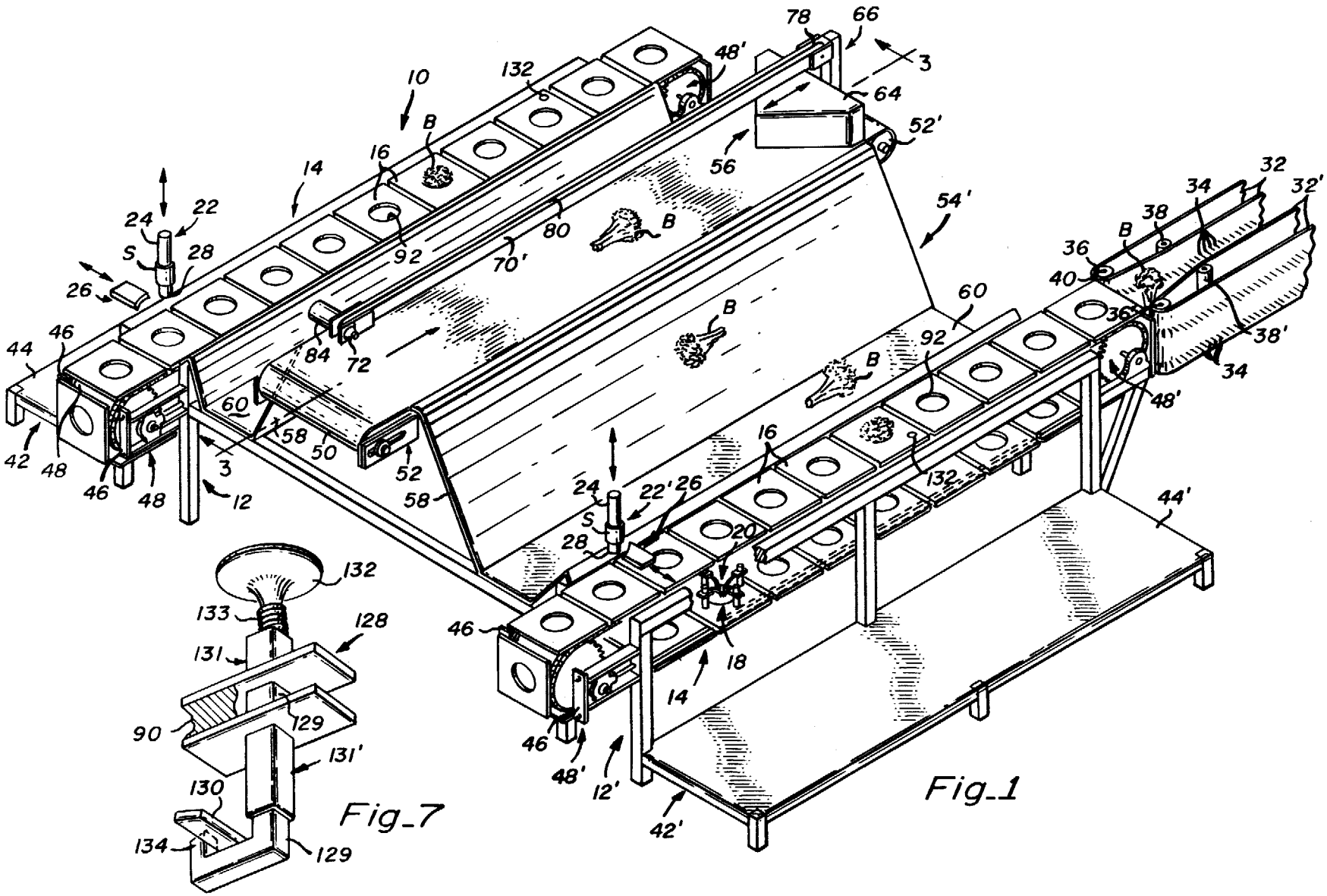
FIG. 1 is a partially diagrammatic, perspective view showing vegetable banding apparatus according to the present invention.
FIG. 7 is a fragmentary, perspective view showing a latch assembly according to the present invention.
Figure 2:
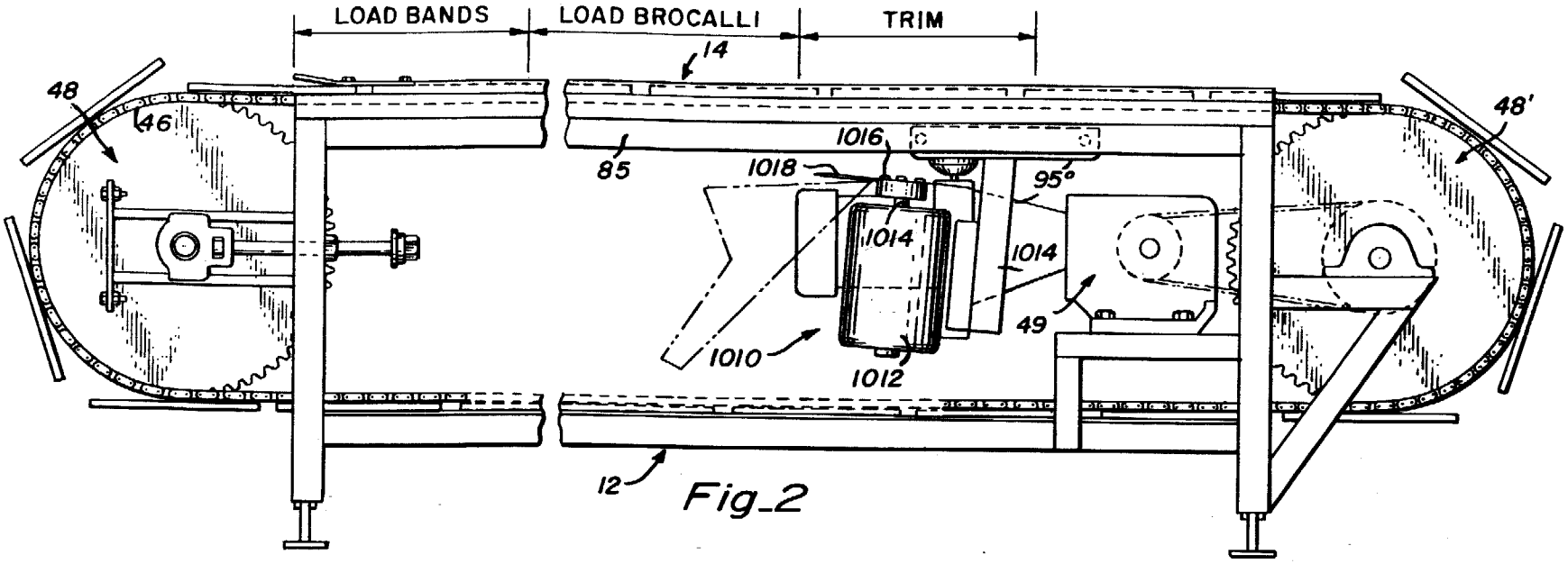
FIG. 2 is a partially diagrammatic, side elevational view of a carrier conveyor as seen in FIG. 1 and illustrating the operating sequence of banding apparatus according to the present invention.
Figure 3:
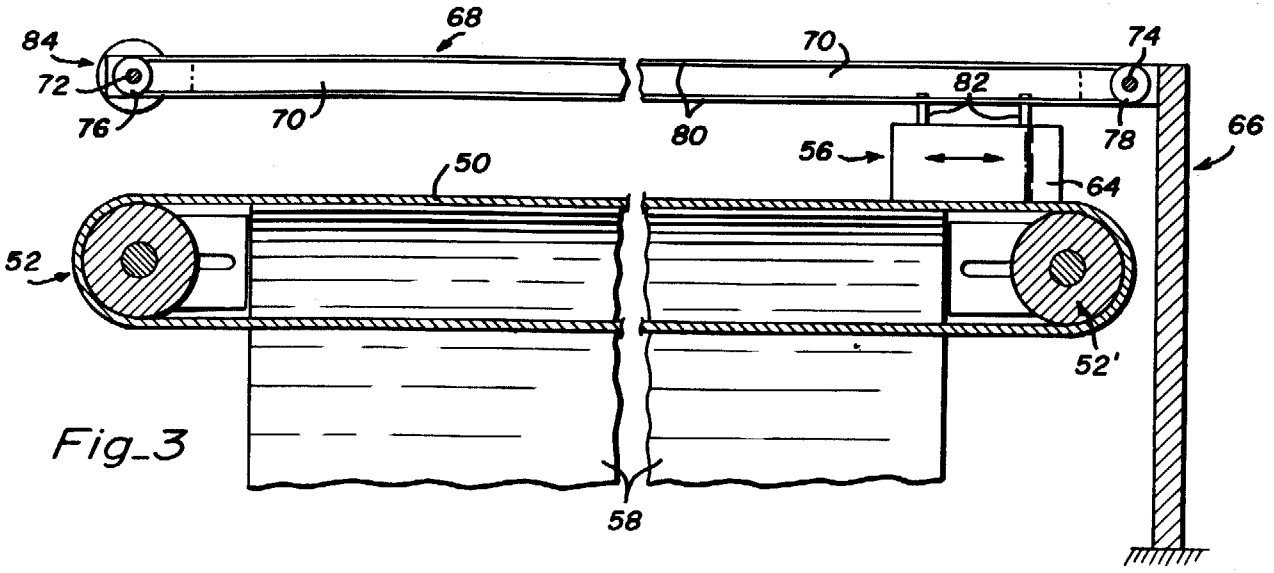
FIG. 3 is a diagrammatic, sectional view taken generally along the line 3—3 of FIG. 1, but with some parts removed for clarity.

Referring now more particularly to FIGS. 1-3 of the drawings, an apparatus 10 according to the present invention for banding vegetables, and the like, comprises a supporting frame 12 and 12' on which is arranged in spaced relation a pair of co-extensive, continuous, carrier conveyors 14 and 14' arranged for receiving bundles B and each including a plurality of segments 16 articulated to one another in a suitable manner. Each of the segments 16 has associated therewith an expander assembly 18 arranged for expanding and retracting elastic bands E. Each of the expander assemblies 18 in turn has an actuator arrangement 20 connected thereto for alternately expanding and retracting the expander assembly 18 in order to manipulate an associated elastic band E as desired.

Each of the conveyors 14, 14' advantageously is provided with a band loading arrangement 22, 22' which operates in conjunction with stop 26, both of which are illustrated schematically in FIG. 1. Band loading arrangements are well known to those skilled in the art. For example, one such band loading arrangement is illustrated in U.S. Pat. No. 3,393,633, issued July 23, 1963, to Ed Hoffman, et al., for a "Rubber Band Stretching Method". Thus, the schematic illustration in conjunction with the operational description which follows will teach those skilled in the art how to employ the banding loading technique of this invention. Further, it should be noted that bands may be inserted by hand. The band loading arrangement is disposed in advance of the "Load Broccoli" zone (FIG. 2) of the associated carrier conveyor for placing on the respective expander assembly 18 an elastic band E, and the like, to be used in a subsequent banding operation. Each loading arrangement 22, 22' includes a mandrel 24 disposed over an arm-portion of each of the expander assemblies 18 and being mounted in a conventional manner (not shown) for selective rotating movement as well as reciprocating movement toward and away from the associated conveyor 14, 14'. A sleeve S constructed of a resilient material, such as a natural or synthetic rubber, is arrangeable on mandrel 24 so as to be selectively engaged by a stop device 26 reciprocal toward and away from the mandrel 24 when mandrel 24 is at a point closest to an associated conveyor 14, 14'. Advantageously, stop device 26 is provided with a cutting edge 28 engageable with sleeve S for slicing an increment from same in order to form a band E of desired width. It will be appreciated that simultaneously with the cutting action, proper phasing of the movement of stop device 26 relative to mandrel 24 will permit device 26 to slide the band from mandrel 24 as same moves upwardly away from the associated conveyor 14, 14'. Accordingly, by adjusting the movement of mandrel 24 so that it comes down over an associated expander assembly 18, a band E cut from sleeve S can be caused to slide off of mandrel 24 and be retained on the expander assembly 18.

It also is to be understood that while the use of a sleeve S from which individual bands E are cut with each reciprocating cycle of the mandrel 24, it also is possible to place a plurality of bands E on mandrel 24 and merely have stop device 26 slide each band E from mandrel 24 during each cycle of same.

An extractor arrangement 30 preferably is associated with each of the conveyors 14, 14', with only one arrangement 30 being shown in FIG. 1, for removing banded bundles B therefrom. Each extractor arrangement 30 comprises a cooperating, opposed pair of belts 32, 32' disposed adjacent a discharge position of an associated conveyor 14, 14' and each provided with flexible fingers 34 arranged for engaging a banded bundle B and removing same from the associated conveyor 14, 14'. Each of the belts 32, 32' is trained over a respective head pulley 36, 36' and advantageously a pair of idler pulleys 38, 38', respectively, arranged adjacent the head pulleys 36, 36' but offset toward one another so as to form a throat 40 which permits each bundle B to be engaged only by the head portion thereof and gently pulled from an associated expander assembly 18.

Frames 12, 12' include a pair of substantially vertical frameworks 42 and 42' respectively supporting conveyors 14 and 14' and having extending horizontally from a base portion thereof a platform 44, 44' on which workers (not shown) can stand while inserting bundles B into expander assemblies 18. Each of the conveyors 14, 14' includes chains 46 on which segments 16 are affixed and arranged between a pair of adjustable dual-sprocket assemblies 48, 48' in a conventional manner which will not be described in greater detail herein. A drive motor unit 49, also conventional, activates assembly 48, to move chain 46.

A belt conveyor 50 of generally conventional construction and forming a continuous surface for receiving bundles B to be banded is arranged on conventional adjustable pulley assemblies 52 and 52' for extending substantially parallel to and co-extensive with conveyors 14 and 14'. Advantageously, conveyor 50 is arranged at a higher elevation than conveyors 14, 14' with aprons 54 and 54' being arranged between conveyor 50 and respective ones of conveyors 14 and 14'. A diverter assembly 56 is associated with conveyor 50 for directing bundles B to be banded off of conveyor 50 and onto the aprons 54, 54'.

Each of the aprons 54, 54' comprises a ramp 58 arranged sloping downwardly from conveyor 50 to a point substantially centrally of the height of an associated continuous conveyor 14, 14'. A substantially planar surface 60 extends from the lower terminal portion of ramp 58 and is arranged lying in a plane substantially parallel to conveyor 50. Sloping from the surface 60 toward an upper portion of an associated continuous conveyor 14, 14' is a wall (not shown) cooperating with surface 60 and ramp 58 to form a trough between conveyor 50 and associated one of the conveyors 14, 14'. In this manner, bundles B to be banded which are diverted from conveyor 50 by assembly 56, such bundles B having been placed on conveyer 50 as by workers (not shown), will slide down the ramp 58 of an associated one of the aprons 54, 54' and onto surface 60 and the bottom of the trough so formed. Once on surface 60, the bundles B can be picked up by workers (not shown) standing on an associated one of the platforms 44, 44' and placed into the expander assemblies 18 when same are in the "Load Broccoli" zone illustrated in FIG. 2.

Diverter assembly 56 includes a wedge 64 arranged symmetrically over conveyor 50 for dividing bundles B somewhat equally between aprons 54 and 54'. A support 66 is mounted on frame 12 in a suitable, known manner, for in turn mounting wedge 64 for reciprocating movement above the endless belt conveyor 50. This support 66 has extending from an upright portion thereof a beam 68 comprising a pair of spaced, substantially parallel rails 70 and 70' held together in spaced relation by shaft 72 and 74 on which are journalled pulleys 76 and 78 receiving an endless belt 80 on which wedge 64 is suitably supported as by the illustrated hangers 82. A drive motor 84 of conventional construction is connected to shaft 72 for reciprocating wege 64 in a conventional manner; as by periodic reversal of the direction of rotation of motor 84. By this arrangement, wedge 64 will reciprocate back and forth over the extent of the top run of conveyor 50 in order to deflect bundles B placed on conveyor 50 laterally onto the ramps 58 of the aprons 54 and 54'. Further, this deflection will occur in both directions of reciprocal movement of wedge 64 due to movement of conveyor 50 relative to the wedge 64.

A trimming assembly 1010 is disposed adjacent the discharge end of conveyor 14 in order to trim the lower ends of banded bundles B. This assembly 1010 includes a conventional motor 1012 mounted on a canterlever bracket 1014 disposed at approximately a 95° angle with respect to the upper rail 85 of frame 12. Mounted on an output shaft 1015 of motor 1012 is a subassembly including a hub 1016 and a circular saw blade 1018, with the latter being arranged at a slight angle with the respect of the longitudinal extent of conveyor 14 so as to cut off the broccoli stalks, and the like, below band E at a slight angle. A chute 1020 advantageously is arranged adjacent a peripheral portion of saw blade 1018 which will be intially engaged by the stalks of bundles B so as to escort the trimmed portions of the bundles B away from the trimming area.

Referring now to FIGS. 4 through 7 of the drawings, each expander assembly 18 comprises a plurality of arms 86, 86', and 86'' pivotally mounted on an annular ring 88 for rotation about axes substantially perpendicular to a plane of an associated segment 16 in the form of a planar plate 90 having an opening 92 provided centrally thereof. Arms 86, 86', 86'' are arranged so as to extend from ring 88 to plate 90 and toward opening 92 provided therein. Each of the arms 86, 86', 86'' includes a block 94, 94', 94'' respectively, pivotally mounted on ring 88 as by the illustrated pivot shaft 96 received in a cooperating socket 98 provided in the ring 88. The latter can be secured to the under surface of plate 90 as by the illustrated screws flush with the upper surface of plate 90.

Extending from blocks 94, 94', 94'' are curved band pins 100 which extend upwardly toward opening 92 provided in plate 90 and terminate in tips 102 arranged for releasably receiving an elastic band E to be placed on a bundle B to be banded.

As shown, there are four arms 86, 86' 86" in each of the expander assemblies 18. Mounted on the frame of each conveyor 14, 14' in a suitable manner at the beginning of the "load broccoli" zone (FIG. 2) is a cam 104 (FIG. 4) arranged for being engaged by a cam follower 106 including a rotatably mounted roller 107 on the outward end of block 94' of arm 86'. A transmission system 108 is attached to arms 86, 86', 86" for transmitting motion to arms 86', 86" from motion of arm 86, and contrarily, due to engagement of cam follower 106 with cam 104. This transmission system 108 is illustrated as comprising a plurality of adjustable links 110, with three such links 110 being provided with the illustrated mode, pivotally mounted on and arranged extending between the pair of like arms 86' and the embracing or linkage terminating arms 86 and 86". Each of the adjustable links 110 is formed by a hollow sleeve 112, and the like, having retained in each longitudinal, open end thereof a suitable nut 114 threadingly receiving the screw threaded shanks of associated rod ends 116 which cooperate with sleeve 112, and nuts 114, to form a turnbuckle type arrangement. Lock nuts 118 preferably are provided to prevent the coupling from working loose. By this arrangement, the swing of each individual one of the band pins 100 can be adjusted by use of the adjustable links 110. Each of the rod ends 116 of each of the links 110 is pivotally mounted in a conventional manner, such as by the illustrated screw fasteners, to an associated one of ears 120 provided one each to the blocks 94, 94" of arms 86 and 86" and two each to the block 94' of arms 86'.

Figure 5:
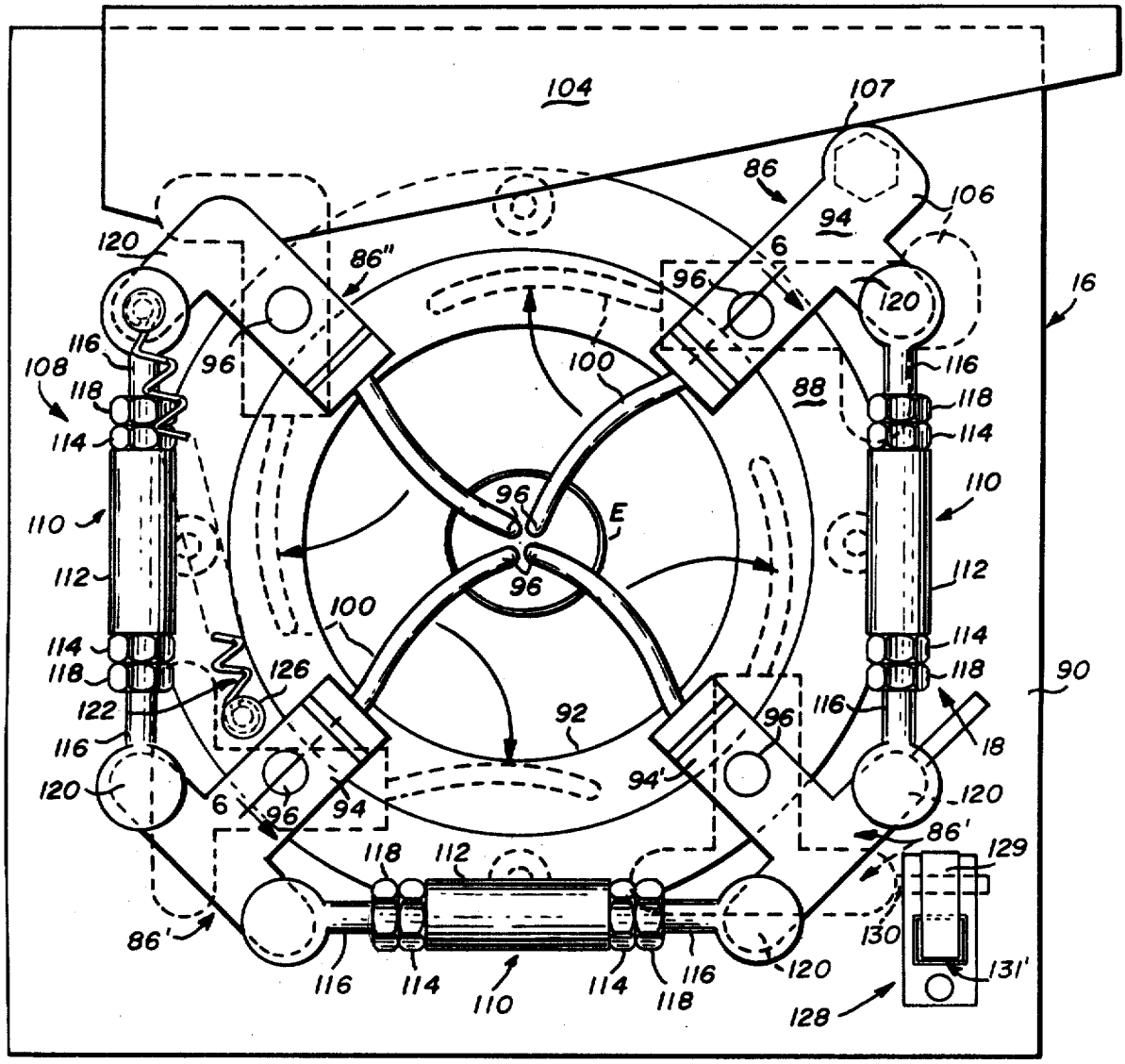
FIG. 5 is a bottom plan view of the expander assembly segment seen in FIG. 4.

A suitable tension spring 122 is anchored to a pair of pins 124 and 126 extending co-directionally from ear 120 of arm 86" and ring 88, respectively, of an expander assembly 18 so as to bias arm 86", and therefore arms 86 and 86' toward their normal or rest position as shown in full lines in FIG. 5 after cam follower 106 disengages from cam 104. Although a suitable stop (not shown) can be provided to cause the arms 86, 86' and 86" to come to rest in the desired position, abutment of the tips 102 of the band pins 100 against each other is generally sufficient for this purpose.

It may not be possible for a worker or workers loading bundles B into expander assemblies 18 to load every assembly 18 during the time same is passing by the cam 104. Accordingly, it is necessary that the arms 86, 84' and 86" be retained in their open position, that shown in broken lines in FIG. 5, until such time as the particular assembly 18 has been loaded. For this purpose, a spring latch 128 (FIG. 7) including a reciprocating hooked rod 129 arranged for receiving an extension of one of the adjustable links 110 is disposed extending through a plate 90 of a particular segment 16 in order to engage the extension of link 110 and restrain in the particular direction of movement thereof back toward the normal or rest position of the arms 86, 86' and 86" and prevent same from returning to the full line position as seen in FIG. 5 until the associated expander assembly 18 has been loaded. Rod 129 is slideably disposed in a pair of sleeves 131, 131' mounted on opposed sides of plate 90 and arranged around a hole provided in plate 90 through which rod 129 extends. Rod 129 has a button 132 forming a head actuatable manually by a worker (not shown) once the associated assembly 18 has been loaded. As will be appreciated, depression of button 132 against the bias of a coiled compression spring 133 will cause projection 134 of rod 129 of latch 128 to release relative to extension 130 of an associated link 110 and permit the links 110 to move in such a manner as to permit expander assembly 18 to return to a rest position.

Operation of the Embodiment of FIGS. 1–7

Figure 4:
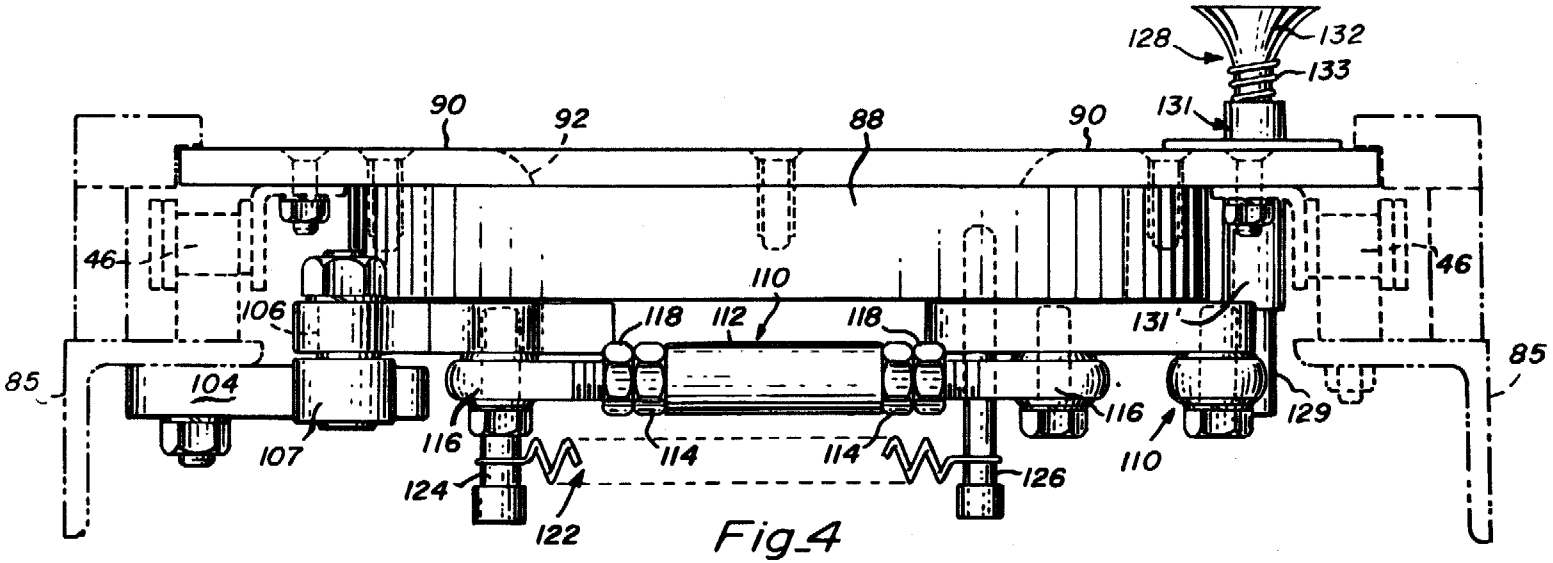
FIG. 4 is a side elevational view, with some parts removed for clarity of an expander assembly containing segment of a continuous conveyor used with apparatus according to the present invention and as seen in FIGS. 1 and 2.
Figure 6:
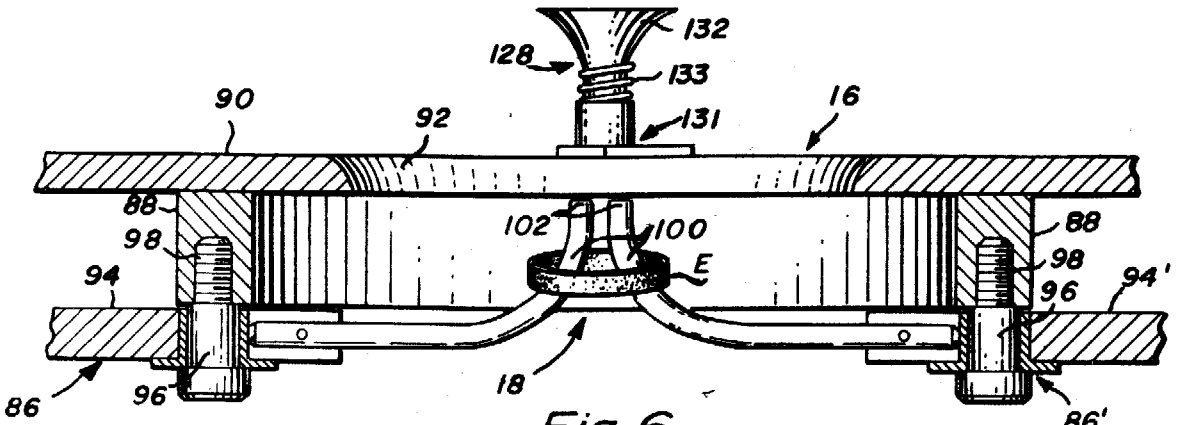
FIG. 6 is a sectional view, with some parts removed, taken generally along the line 6—6 of FIG. 5.

Referring to FIGS. 1 and 2 of the drawings, it will be appreciated that the arms 86, 86' 86" each expander assembly 18 will be in a closed position, as seen in full lines of FIGS. 4–6, at all times except when the segment 16 associated with a specific expander assembly 18 is in the "Load Broccoli" zone. Thus, loading arrangement 22 acts to deposit an elastic band E on each expander assembly 18 as same passes by the station of a loading arrangement 22. Subsequent to such placing of an elastic band E on an expander assembly 18, cam follower 106 will engage cam rail 104, causing block 94', and therefore blocks 94' and 94", to pivot and bring the band pins 100 into the open position shown by broken lines in FIG. 5. Latch 128 retains pins 100 in their open position. An associated elastic band E has simultaneously been expanded so as to permit a bundle B to be placed within the band E by workers (not shown) who picked the bundles from aprons 54 and 54'. The bundles B are deposited on the aprons 54, 54' by placement on conveyer 50 by workers (not shown).

Once bundles B have been placed within an expanded elastic band E, the band pins 100 associated with a specific expander assembly 18 will be returned to a normal, or closed, mode by action of the workers depressing button 132 and releasing latch 128, permitting band E, and spring 122, to exert a bias on arm 86', and therefore arms 86, 86' and 86". This bias will return the band pins 100 toward their rest position as seen in full lines in FIGS. 1–6. In fact, however, band pins 100 will come to rest against a bundle B being banded. Once the now banded bundle B reaches the end of an associated conveyer 14, 14' spaced from the end associated with a loading arrangement 22, 22', extractor arrangement 30 will engage the banded bundle B and gently remove same from an associated expander assembly 18. Band pins 100 of extractor assemblies 18 will now be free to move to their rest position under the bias of spring 122, and the above sequence can be repeated when the specific segment 16 again reaches an associated loading arrangement 22, 22'.

Figure 8:
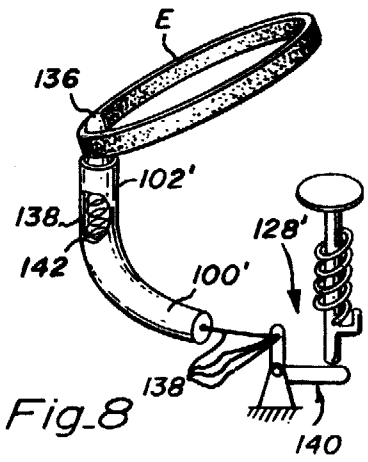
FIG. 8 is a fragmentary, partially diagrammatic, perspective view, partially broken away and in section, showing a modified tip of an arm of an expander assembly.

Description of the Embodiment of FIG. 8

As seen in FIG. 8 of the drawings, each of the tips 102' of band pins 100' can be constructed in the form of a spring detent comprising a plunger 136 biased by a conventional coiled compression spring 138 disposed within a hollow cavity of the associated pin 100', which can be a hollow tube, and connected to a bell-crank 140 by an associated wire 143 for movement into the hollow cavity whenever a latch 128' is depressed so as to pivot bell crank 140 by engagement with one crank arm. The purpose of plunger 136 is to provide a movable surface for receiving an elastic band E so as to facilitate removal of band E from band pins 100 after same has been constricted onto an associated bundle B by retraction of plunger 136 when latch 128' is depressed to release the arms of the band pins 100.

Figure 9:
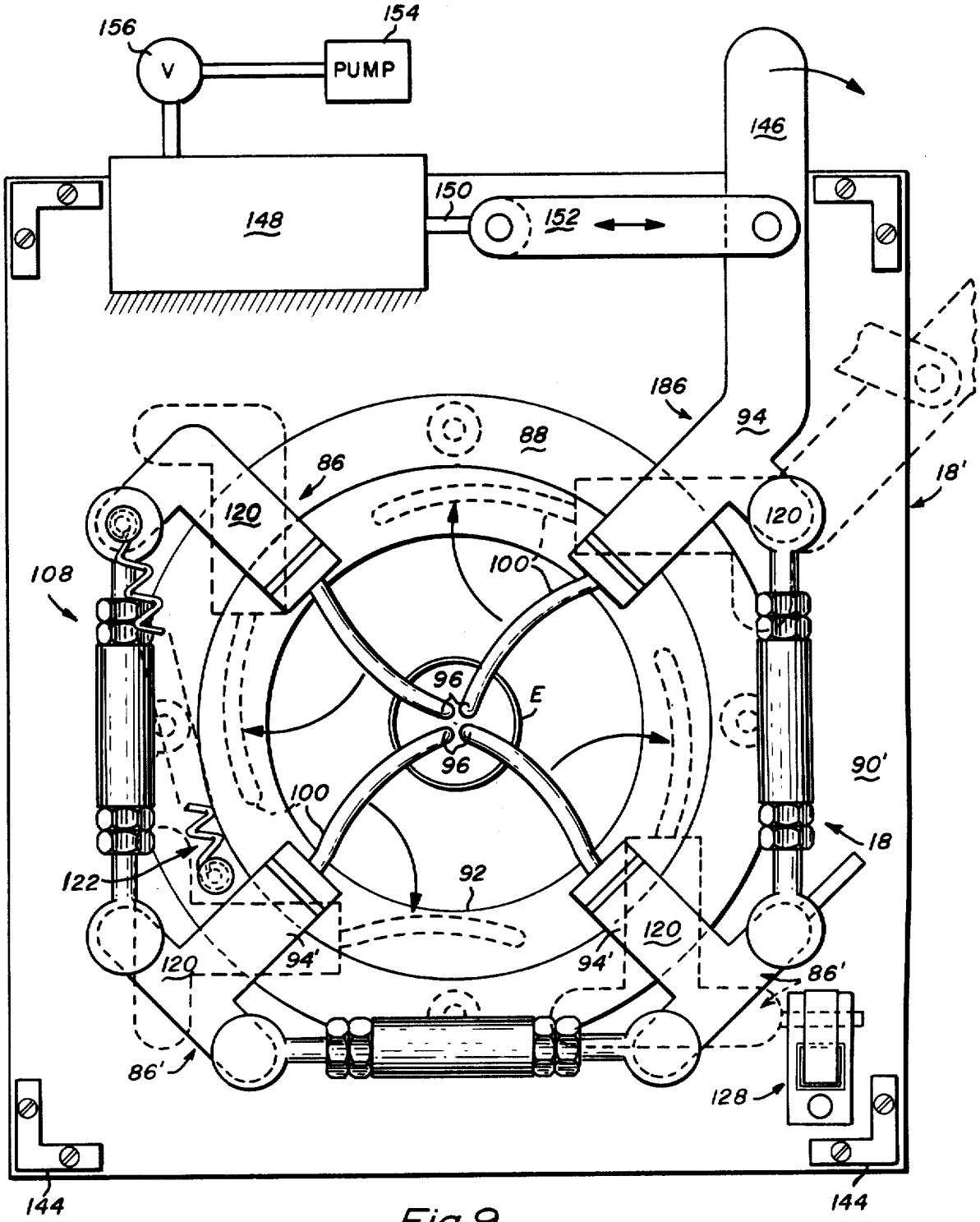
FIG. 9 is a bottom plan view similar to FIG. 5, but showing partially diagrammatic view of a modified embodiment of the present invention.

Description of the Embodiment of FIG. 9

The embodiment of the invention as seen in FIG. 9 comprises an expander assembly 18' including a planar plate 90' mounted on a suitable support, such as that including legs 144, in order to position assembly at a fixed work station (not shown). The linkage shown in FIG. 9 basically is the same as that shown in FIG. 5, with like elements being designated by the same reference numerals, except that arm 86 has been replaced by an arm 186 having a handle 146 in place of cam follower 106. By manually swinging handle 146 in the direction of the arrow, arms 186, 86', and 86'' will move from the illustrated full line portion to the broken line portion. A suitable linear fluid motor 148, or a conventional electric solenoid (not shown) can be suitably mounted on the under surface of plate 90' and have a piston rod 150 thereof pivotally attached to a connecting rod 152 pivotally attached to handle 146 for selectively swinging same as by foot-actuator of a conventional fluid pump 154 connected to motor 148 as by a conventional control valve 156. By the arrangement, handle 146 can be swung by operator actuation of either pump 154, and motor 148, or of handle 146. In either case, latch 128 will return the linkage in arm-open mode (broken lines) until button 132 (not shown in FIG. 9) is depressed.

As can be understood from the above description and from the drawing, vegetable banding apparatus according to the present invention permits workers to band and trim bunches of foodstuffs, such as broccoli, in a highly productive manner without risk of damage to the foodstuffs being handled. Most importantly, the workers perform only a single function, that of loading bundles of foodstuffs into expanded extractor assemblies, thus reducing the chance of operator error and permitting the workers to concentrate on a single operation.

Whereas, the preferred embodiment of the present invention has been described above, it is contemplated that other alterations and modifications may become apparent to those skilled in the art after having read the above disclosure. It is therefore intended that the appended claims be interpreted as covering all such alterations and modifications as fall within the true spirit and scope of the invention.

What is claimed is:

1. Vegetable banding apparatus, comprising, in combination:

(a) a supporting frame;

(b) conveyor means including a carrier conveyor moveably supported on said frame for receiving bundles to be banded, said carrier conveyor including a plurality of segments articulated to one another;

(c) expander means associated with said segments of said carrier conveyor for expanding and retracting elastic bands; and (d) actuator means connected to said expander means for alternately expanding and retracting said expander means.

2. Apparatus as defined in claim 1, further including extractor means associated with said conveyor for removing banded bundles therefrom.

3. Apparatus as defined in claim 2, wherein said extractor means comprises a cooperating, opposed pair of belts disposed adjacent a discharge portion of said carrier conveyor, each of said belts being provided with flexible fingers arranged for engaging a banded bundle and removing same from said continuous conveyor.

4. Apparatus as defined in claim 1, further including loading means associated with said carrier conveyor for placing on said expander means an elastic band.

5. Apparatus as defined in claim 4, wherein said loading means includes a mandrel at least partially hollow for fitting over said expander means and arranged for receiving a sleeve constructed of a resilient material, said mandrel being mounted for reciprocating movement toward and away from said carrier conveyor, and stop means enageable with the sleeve for causing the sleeve to slide off of said mandrel and onto said expander means during movement of said mandrel away from said continuous conveyor.

6. Apparatus as defined in claim 5, wherein said stop means comprises cutting means engageable with a sleeve on said mandrel for slicing an endless strip from same, the endless strip forming an elastic band.

7. Apparatus as defined in claim 1, wherein said conveyor means further includes an endless belt conveyor forming a continuous surface for receiving bundles to be banded and arranged extending substantially parallel to and co-extensive with said carrier conveyor, said belt conveyor being arranged at a higher elevation than said carrier conveyor, apron means arranged between said belt conveyor and said carrier conveyor for transferring bundles from said belt conveyor to a point adjacent said carrier conveyor, and diverter means associated with said belt conveyor for directing bundles to be banded from said belt conveyor and onto said apron means.

8. Apparatus as defined in claim 7, wherein said carrier conveyor has a height, and said apron means includes a substantially planar ramp sloped downwardly from said belt conveyor to a point substantially centrally of the height of said carrier conveyor, a substantially planar surface extending from said ramp and lying in a place substantially parallel to said belt conveyor, and a wall sloped from said surface to an upper portion of said carrier conveyor, said ramp, surface, and wall cooperating to form a trough for receiving bundles to be banded.

9. Apparatus as defined in claim 7, wherein said diverter means includes a wedge, support means mounted on said frame for mounting said wedge for reciprocating movement above said endless belt conveyor, and drive means connected to said support means for reciprocating said wedge.

10. Apparatus as defined in claim 7, wherein said carrier conveyor is one of a pair of substantially identical carrier conveyors arranged in parallel, spaced relation, said endless belt conveyor being disposed between said continuous conveyors, and said ramp, surface and wall being one of a pair of substantially identical ramps, surfaces and walls forming assemblies arranged extending from said belt conveyor to respective ones of said carrier conveyors.

11. Apparatus as defined in claim 10, wherein said carrier conveyor has a height, and said apron means includes a substantially planar ramp sloped downwardly from said belt conveyor to a point substantially centrally of the height of said carrier conveyor, a substantially planar surface extending from said ramp and lying in a place substantially parallel to said belt conveyor, and a wall sloped from said surface to an upper portion of said carrier conveyor, said ramp, surface, and wall cooperating to form a trough for receiving bundles to be banded.

12. Apparatus as defined in claim 11, wherein said diverter means includes a wedge, support means mounted on said frame for mounting said wedge for reciprocating movement above said endless belt conveyor, and drive means connected to said support means for reciprocating said wedge.

13. Apparatus as defined in claim 12, further including extractor means associated with said carrier conveyor for removing banded bundles therefrom.

14. Apparatus as defined in claim 13, wherein said extractor means comprises a cooperating, opposed pair of belts disposed adjacent a discharge portion of said carrier conveyor, each of said belts being provided with flexible fingers arranged for engaging a banded bundle in removing same from said continuous conveyor.

15. Apparatus as defined in claim 14, further including loading means associated with said carrier conveyor for placing on said expander means an elastic band.

16. Apparatus as defined in claim 15, wherein said loading means includes a mandrel at least partially hollow for fitting over said expander means and arranged for receiving a sleeve constructed of a resilient material, said mandrel being mounted for reciprocating movement toward and away from said carrier conveyor, and stop means engageable with the sleeve for causing the sleeve to slide off of said mandrel and onto said expander means during movement of said mandrel away from said continuous conveyor.

17. Apparatus as defined in claim 16, wherein said stop means comprises cutting means engageable with a sleeve on said mandrel for slicing an endless strip from same, the endless strip forming an elastic band.

18. Apparatus as defined in claim 1, further including trimming means associated with said carrier conveyor for trimming bundles banded by said expander means, said trimming means including a motor and a circular saw blade mounted on said motor for rotation thereby, said circular saw blade being planar and rotating about an axis of rotation disposed at approximately a 95° angle with respect to an adjacent path of said carrier conveyor in a direction opposite to a direction of movement of said carrier conveyor along the adjacent path thereof.

19. Apparatus as defined in claim 1, wherein said segments each comprise a planar plate, and said expander means includes a plurality of pivotally mounted arms arranged on said plate for expanding and retracting elastic bands, said arms of said expander means being mounted for swinging around axes substantially perpendicular to a plane of said plate, said plate being provided with an opening, and said arms being curved and extending to the opening of said plate.

20. Apparatus as defined in claim 19, wherein said actuator means includes a cam provided on said supporting frame, a cam follower affixed to one of said arms and arranged for being engageable with said cam, and transmission means attached to said one of said arms and to the other of said arms for transmitting motion from said one of said arms to the other of said arms.

21. In an apparatus for banding bundles of vegetables, and the like, comprising a support including a substantially planar plate, expander means including a plurality of pivotally mounted arms arranged on said plate for expanding and retracting elastic bands, and actuator means associated with said support and connected to said expander means for alternately expanding and retracting said expander means and, therefore, an elastic band arrangeable on said expander means, the improvement wherein said arms of said expander means are disposed in spaced apart relationship and respectively swing about different axes substantially perpendicular to a plane of said plate and transmission means attached to said arms for transmitting motion from one of said arms to the other of said arms.

22. An improvement as defined in claim 21, wherein said expander means further includes each of said arms terminating in a tip adjacent said plate, said tip comprising a spring detent arranged for facilitating removal of an elastic band from said arms.

23. An improvement as defined in claim 21, wherein said expander means includes a ring, and each of said arms being mounted on said ring, said plate being provided with an opening, and said arms being curved and extending to the opening provided in said plate.

24. An improvement as defined in claim 23, wherein said support is mounted for movement along a path of movement, and said actuator means includes a cam provided adjacent the path of movement of said support and a cam follower affixed to one of said arms and arranged for being intermittently engageable with said cam.

25. An improvement as defined in claim 24, wherein said transmission means includes a plurality of links, each of said links being pivotally attached to a respective adjacent pair of said arms for transmitting motion of one of said arms to the other of said arms.

26. An improvement as defined in claim 25, wherein each of said arms comprises a block portion journalled on said ring, and a band pin portion affixed to and extending from said block portion, said transmission means being associated with said block portion, said cam follower being formed by an associated block portion being elongated relative to said block portion of said other of said arms and arranged for engaging with said cam.

27. An improvement as defined in claim 25, wherein there are four of said arms mounted on each said ring.

28. An improvement as defined in claim 27, wherein said expander means is mounted for movement along a path of movement, and said cam is mounted adjacent the path of movement of said expander means for intermittently engaging said cam follower.

29. An improvement as defined in claim 21, wherein there are four of said arms mounted on each said plate.

30. An improvement as defined in claim 21, wherein said support includes a cam, and each of said arms comprises a block portion journalled on said plate, and a band pin portion affixed to and extending from said block portion, said transmission means attached to said block portion for transmitting motion from each of said arms to another of said arms, and a one of said arms having a block portion which forms a cam follower partially forming said actuator means and arranged for engaging with said cam and causing said transmission means to move all of said arms simultaneously.

31. An improvement as defined in claim 21, wherein said transmission means includes a plurality of links, each of said links being pivotally attached to a respective adjacent pair of said arms for transmitting motion of one of said arms to the other of said arms, and a latch means associated with said transmission means for retaining said arms in a position expanding an associated elastic band until such time as a bundle to be banded is inserted within an associated expanded elastic band.

32. An improvement as defined in claim 31 wherein said actuator means includes operator actuated means affixed to one of said arms for being selectively engageable and swingable for moving said arms into an elastic band expanding mode.

33. An improvement as defined in claim 31, wherein said latch means includes an extension provided on a one of said arms, and a resiliently mounted reciprocating latch arranged for selectively engaging siad extension and retaining same and its associated one of said arm from movement.

34. An improvement as defined in claim 33 wherein said actuator means includes operator actuated means affixed to one of said arms for being selectively engageable and swingable for moving said arms into an elastic band expanding mode.

* * * * *